US007930987B2

(12) United States Patent
Mizutani

(10) Patent No.: US 7,930,987 B2
(45) Date of Patent: Apr. 26, 2011

(54) ELECTRIC STEERING DEVICE FOR WATERCRAFT AND CONTROL METHOD OF ELECTRIC STEERING DEVICE

(75) Inventor: Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 195 days.

(21) Appl. No.: 12/238,516

(22) Filed: Sep. 26, 2008

(65) Prior Publication Data

US 2009/0084299 A1 Apr. 2, 2009

(30) Foreign Application Priority Data

Sep. 28, 2007 (JP) ..... 2007-254165

(51) Int. Cl.
*B63H 25/00* (2006.01)

(52) U.S. Cl. ..... 114/144 RE

(58) Field of Classification Search ..... 114/144 RE, 114/170, 171; 440/53
See application file for complete search history.

(56) References Cited

U.S. PATENT DOCUMENTS 2,796,576 A * 6/1957 Braddon et al. ..... 318/588
3,181,272 A * 5/1965 Gibson ..... 446/154
4,004,537 A * 1/1977 Nilsson ..... 114/144 R
4,782,907 A * 11/1988 Morishita et al. ..... 180/412
7,156,034 B2 * 1/2007 Mizutani ..... 114/162
7,549,901 B2 * 6/2009 Mizuguchi et al. ..... 440/1
2003/0024783 A1 * 2/2003 Monahan et al. ..... 192/38
2005/0288838 A1 * 12/2005 Takaki et al. ..... 701/41

FOREIGN PATENT DOCUMENTS

JP 2006-076413 A 3/2006

OTHER PUBLICATIONS

Murai et al., "Propulsion Device", U.S. Appl. No. 12/695,226, filed Jan. 28, 2010.

* cited by examiner

*Primary Examiner* — Stephen Avila
(74) *Attorney, Agent, or Firm* — Keating & Bennett, LLP

(57) ABSTRACT

An electric steering device includes a steering retaining device arranged to retain a steering angle against an external steering force applied from outside of a watercraft to an outboard motor main body. A reverse input shutoff clutch, for example, is preferably used as the steering retaining device. A steering retaining state in which a steering angle of the outboard motor main body is retained can be detected from a steering condition of the outboard motor main body, and a control is made to stop electric power from being supplied to an electric motor steering the outboard motor main body. Accordingly, the steering retaining device retains a steering angle while steering is retained, and thus the electric power supply to the electric motor can be stopped, which allows electric power to be saved. The steering retaining device provides an electric steering device for a watercraft in which no electric power is required when applying a steering retaining force for retaining a counter-steering state.

12 Claims, 7 Drawing Sheets

ELECTRIC STEERING DEVICE FOR WATERCRAFT AND CONTROL METHOD OF ELECTRIC STEERING DEVICE

BACKGROUND OF THE INVENTION

1. Field of the Invention

The present invention relates to an electric steering device for a watercraft in which a steering operation is performed with power from an electric driving device, and more particularly to an electric steering device for a watercraft in which the electric driving device consumes no electric power while a steering angle is retained, and a control method of the electric steering device.

2. Description of the Related Art

There are cases when a boat, a watercraft having an outboard motor, or the like retains its rudder slightly steered at a certain steering angle to compensate for the influence of a wind direction and/or a tidal current even though it is traveling in a straight direction. Such a steering state is called "counter-steering". During counter-steering, it is required to continuously apply an appropriate retention force to retain a prescribed steering angle against a steering force by propeller reaction or water current since the rudder receives the steering force by the propeller reaction or the water current pushing the rudder back to a straight traveling state. A similar situation occurs in cases of maintaining turning in traveling, docking, and so forth.

It is required to retain a state in which the driving force of the electric driving device keeps being applied to the rudder to obtain the retention force mentioned above in the electric steering device performing the steering operation by using the electric driving device, such as an electricmotor. However, the electric driving device needs to be constantly supplied with electric power in such a situation. This results in a large consumption of electric power. Furthermore, a steering angle may veer off of a target angle due to propeller reaction and/or a water current in a circumstance that electric power is not sufficiently supplied, such as during a power failure.

To solve such a problem, there is disclosed a steering device which includes a plurality of steering control devices arranged to apply a driving electric current corresponding to the difference between a target steering angle and an actual steering angle to each of a plurality of electric motors thereby steering a steering wheel to a target steering angle, a stoppage detecting device arranged to detect stoppage of a steering operation of the steering wheel, and an electric current reducing device arranged to stop the steering control by a portion of the steering control devices among the plurality of steering control devices when the stoppage detecting device detects that the steering operation of the steering wheel is stopped and reduces the driving electric current applied to the electric motors by the portion of the steering control device when the steering operation of the steering wheel is stopped (see Patent JP-A-2006-076413, for example).

However, there is a problem that a plurality of electric motors and a detecting device are required in the above conventional steering device, thus a construction of the steering device is complicated, which increases the production cost.

SUMMARY OF THE INVENTION

In order to overcome the problems described above, preferred embodiments of the present invention provide an electric steering device for a watercraft in which no electric power is required when a steering retaining force is applied to retain counter-steering, and which is also simple and compact, reduces cost, is highly reliable, can maintain the steering retaining force during an electric power shortage. A control method of the electric steering device is also provided.

To achieve the above described benefits and advantages, a first preferred embodiment of the present invention provides an electric steering device for a watercraft which performs a steering operation by power from an electric driving device possible, and includes a steering retaining device arranged to retain a steering angle against an external steering force applied to a rudder body.

A second preferred embodiment of the present invention provides an electric steering device for a watercraft in accordance with the first preferred embodiment, in which the steering retaining device is a reverse input shutoff clutch.

A third preferred embodiment of the present invention provides an electric steering device for a watercraft in accordance with the first or second preferred embodiments, in which the electric driving device is an electric motor, output of the electric motor is transmitted to the rudder body after the speed of the output of the electric motor is reduced by a speed reducing device, and the steering retaining device is provided substantially in the middle in a rotation transmitting path between the electric motor and the speed reducing device.

A fourth preferred embodiment of the present invention provides an electric steering device for a watercraft in accordance with the third preferred embodiment, in which the steering retaining device is provided coaxially with a motor shaft of the electric motor.

A fifth preferred embodiment of the present invention provides an electric steering device for a watercraft in accordance with the third or fourth preferred embodiments, in which the speed reducing device includes a speed reducing gear train and a ball screw device such that rotation of the electric motor is transmitted to a ball screw shaft of the ball screw device after the speed of the rotation of the electric motor is reduced by the speed reducing gear train, and the motor shaft of the electric motor and the ball screw shaft are disposed adjacent to each other in the watercraft fore-and-aft direction such that an axial line of each of the motor shaft and the ball screw shaft is along the watercraft width direction.

A sixth preferred embodiment of the present invention provides an electric steering device for a watercraft in accordance with any of the first through fifth preferred embodiments, in which a controlling device can control shifting of the steering retaining device between a steering retaining state and a free state.

A seventh preferred embodiment of the present invention provides a control method for an electric steering device for a watercraft including detecting, from a steering state of the rudder body, that a steering angle of the rudder body is retained in a steering retaining state; and controlling the electric steering device to stop electric power supply to the electric driving device arranged to steer the rudder body.

An eighth preferred embodiment of the present invention provides a method for an electric steering device for a watercraft including controlling a steering retaining device to become a steering retaining state in which a steering retaining device retains a steering angle of the rudder body when an electric power supply to an electric driving device arranged to steer the rudder body is stopped.

In the first preferred embodiment of the present invention, the steering retaining device retains a steering angle against an external steering force applied to the rudder body from outside the watercraft during counter-steering. Therefore, it is not required to retain a steering angle by supplying power to the electric driving device as in the conventional art. Accordingly, electric power supplied to the electric driving device can be saved.

In the second preferred embodiment of the present invention, the steering retaining device is a simple mechanical reverse input shutoff clutch. Therefore, the construction of the steering retaining device is simplified. The steering retaining device can be maintained during power shortage, and a reliability of the steering retaining device can be enhanced.

In the third preferred embodiment of the present invention, the steering retaining device is provided between the electric driving device (for example, an electric motor) and the speed reducing device. Therefore, the steering force applied from the rudder body to the steering retaining device, that is, a reverse driving torque, can be damped by the speed reducing device. Thereby, a torque capacity of the steering retaining device can be reduced. As a result, the steering retaining device can be made smaller, and the electric steering device can be made more compact.

In the fourth preferred embodiment of the present invention, the reverse driving torque transmitted from the rudder body to the steering retaining device can be minimized, and the steering retaining device can be made even smaller. Accordingly, the electric steering device can be made even more compact.

Further, in the fifth preferred embodiment of the present invention, the entire electric steering device has a very compact structure and very small size.

In the sixth preferred embodiment of the present invention, the controlling device can control shifting of the steering retaining device between the steering retaining state and the free state. Therefore, retention of the steering angle or release from the retention of the steering angle can be more precisely and more effectively controlled.

In the seventh preferred embodiment of the present invention, electric power is not required to apply a steering retaining force for retaining the counter-steering state. Accordingly, electric power can be saved.

In the eighth preferred embodiment of the present invention, the steering retaining force can be maintained even in a power shortage, and the rudder body can be locked while the watercraft is not in use.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described hereinafter.

First Preferred Embodiment

Figure 1:
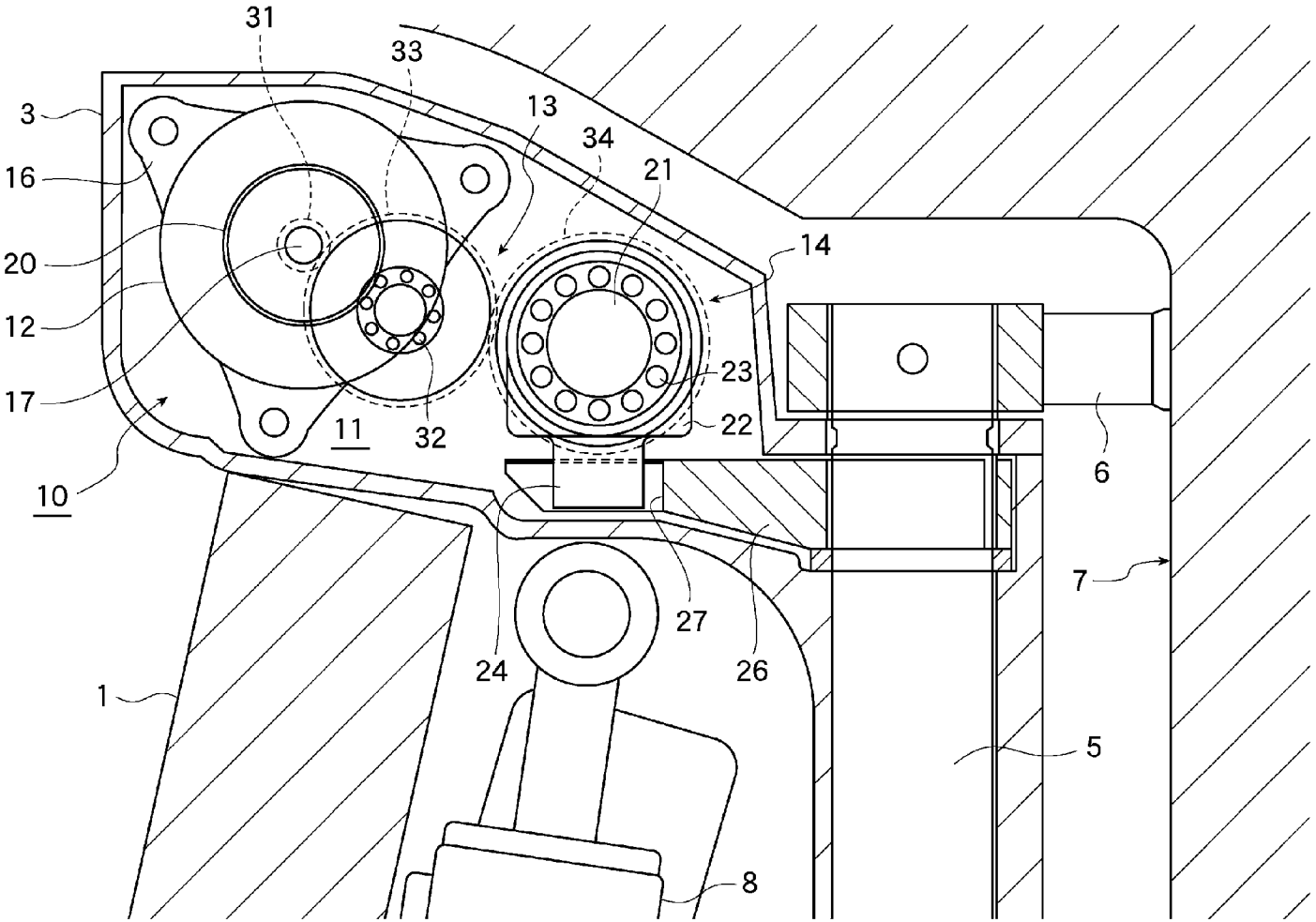
FIG. 1 is a left side view showing a steering portion of an outboard motor of an electric steering device for a watercraft in accordance with a first preferred embodiment of the present invention.
Figure 2:
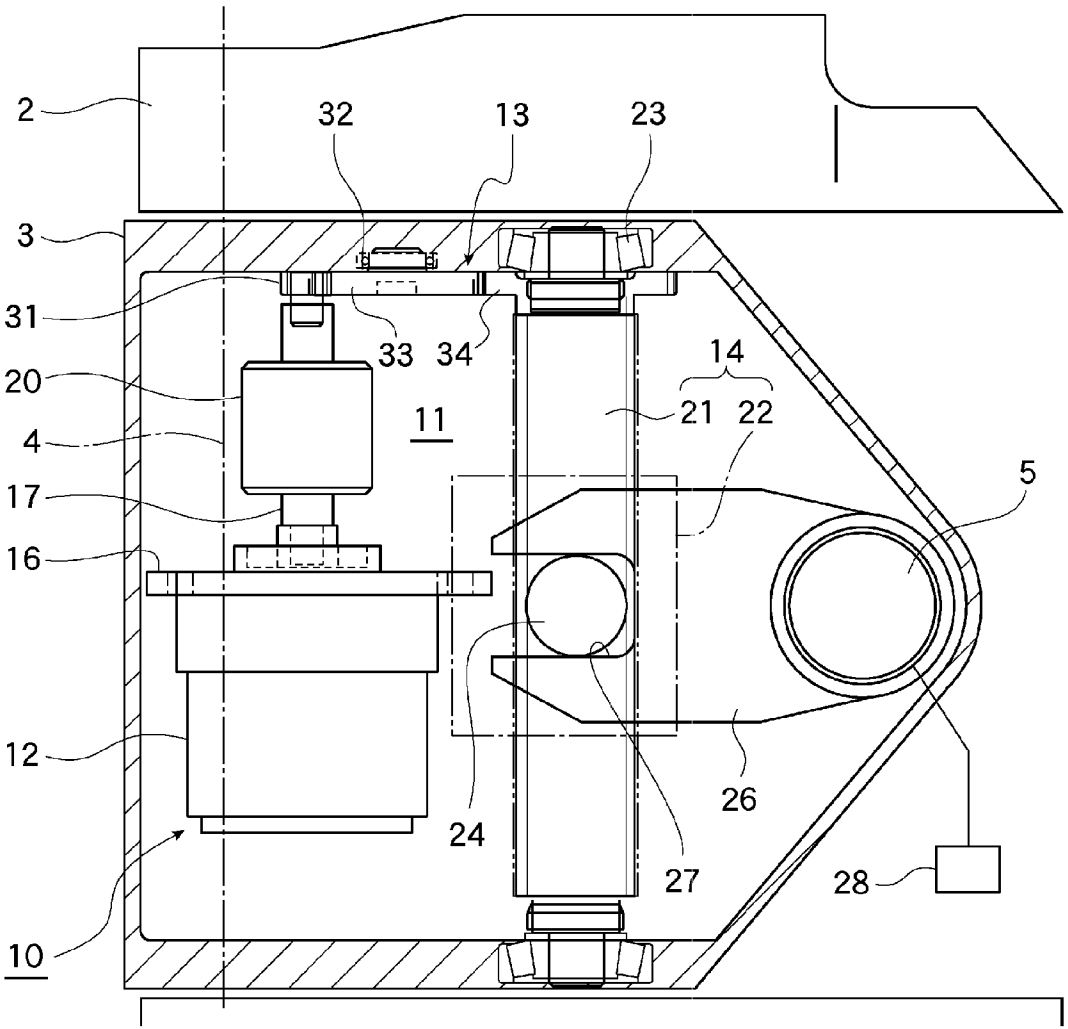
FIG. 2 is a plan view showing the steering portion of the outboard motor of the electric steering device for a watercraft in accordance with the first preferred embodiment of the present invention.

FIG. 1 is a left side view showing an area in the vicinity of a steering portion of an outboard motor of an electric steering device for a watercraft in accordance with a first preferred embodiment of the present invention. FIG. 2 is a plan view showing an area in the vicinity of the steering portion. The left sides of FIGS. 1 and 2 correspond to the traveling direction of the watercraft.

As shown in FIG. 2, a bracket clamp 2 is fixed to a transom 1 of the watercraft shown in FIG. 1. A swivel bracket 3 is coupled to the bracket clamp 2 rotatably around a horizontal supporting shaft 4 (see FIG. 2). A pivot shaft 5 is pivotally supported by the swivel bracket 3 in a rotatable manner. An outboard motor main body 7 is coupled to both the upper and lower ends of the pivot shaft 5 via coupling arms 6.

The outboard motor main body 7 can be turned to the right or the left around the pivot shaft 5 relative to the swivel bracket 3 and the transom 1, and tilted up together with the swivel bracket 3 around the horizontal supporting shaft 4. The outboard motor main body 7 and the swivel bracket 3 are tilted up by a tilting hydraulic cylinder 8. When the outboard motor main body 7 turns to the right or the left around the pivot shaft 5, the watercraft is steered.

The outboard motor main body 7 is turned to the right or the left by an electric steering device 10. The electric steering device 10 is disposed in a steering compartment 11 installed inside an upper portion of the swivel bracket 3, and transmits an output of an electric motor 12 to the pivot shaft 5 and the outboard motor main body 7 after reducing a speed of the output by using a speed reducing gear train 13 and a ball screw device 14.

The pivot shaft 5 is pivotally and substantially perpendicularly supported in a rear portion of the steering compartment 11. The electric motor 12 is fixed to a front portion of the steering compartment 11 by a fixing plate 16. An axial line of a motor shaft 17 projects along the watercraft width direction. The motor shaft 17 protrudes from a right side surface of the electric motor 12. A reverse input shutoff clutch 20 (for example, TORQUE DIODE® from NTN Corporation) which will be described in detail later, is provided on substantially the middle of the motor shaft 17.

The ball screw device 14 includes a ball screw shaft 21 and a ball nut 22. The ball screw shaft 21 is disposed between the electric motor 12 and the pivot shaft 5 with its axis arranged along the watercraft width direction, and pivotally supported by a pair of right and left bearings 23 in a rotatable manner. The motor shaft 17 of the electric motor 12 and the ball screw shaft 21 are disposed substantially parallel to each other in the watercraft width direction such that the motor shaft 17 is toward the front and the ball screw shaft 21 is toward the rear.

The ball nut 22 is engaged with the ball screw shaft 21 via a large number of steel balls (not shown). The ball screw shaft 21 rotates, and thereby the ball nut 22 smoothly moves without play in the axial direction. A slide pin 24 preferably having a short column shape is arranged to protrude from a lower surface of the ball nut 22. On the other hand, a steering arm 26 is provided in the vicinity of an upper end of the pivot shaft 5 to unitarily rotate with the pivot shaft 5. The slide pin 24 of the ball nut 22 is slidably engaged with a notch-shaped slider 27 provided at a tip of the steering arm 26 without play. A steering angle detecting sensor 28 is provided to the pivot shaft 5.

The speed reducing gear train 13 includes a drive gear 31 provided at an end of the motor shaft 17 of the electric motor 12 to unitarily rotate therewith, a middle gear 33 pivotally supported by a bearing 32 on a right inner surface of the steering compartment 11, and a driven gear 34 provided at a right end of the ball screw shaft 21 to unitarily rotate therewith, such that all of the gears are engaged together.

Rotation of the electric motor 12 (and the motor shaft 17) is transmitted to the ball screw shaft 21 with its rotational speed reduced by the speed reducing gear train 13 in two steps. The rotation of the ball screw shaft 21 is further reduced through ball screw engagement, and moves the ball nut 22 to the right or the left. The movement of the ball nut 22 is transmitted to the steering arm 26 through engagement between the slide pin 24 and the slider 27. The steering arm 26 turns, and this causes the pivot shaft 5 and the outboard motor main body 7 turn to the right or the left relative to the swivel bracket 3. Thereby, the watercraft can be steered.

Propeller reaction and/or water current cause a steering force to act on the outboard motor main body 7 and push it back to a straight traveling state while an operator counter-steers to compensate for, for example, a wind direction and/or a tidal current. The electric steering device 10 includes a steering retaining device arranged to retain a steering angle against the external steering force applied from the outside of the watercraft.

It is preferable that the steering retaining device have a simple mechanical structure. The reverse input shutoff clutch 20 provided on the motor shaft 17 of the electric motor 12 is an example of a steering retaining device in the first preferred embodiment. The reverse input shutoff clutch 20 is a known rotation transmitting member which is disposed in a rotational driving system. The reverse input shutoff clutch 20 does not transmit rotation from an output side (reverse driving torque) to an input side, and locks rotation although it transmits rotation from the input side (driving torque) to the output side.

It is preferable that the reverse input shutoff clutch 20 of the reverse input locking type used as the steering retaining device be disposed in substantially the middle of a rotation transmitting path between the electric motor 12 and the speed reducing device (the speed reducing gear train 13 and the ball screw device 14). Ideally, the reverse input shutoff clutch 20 should be disposed as close as possible to the electric motor 12 which is the drive source. Therefore, the reverse input shutoff clutch 20 is provided coaxially with the motor shaft 17 of the electric motor 12 in the first preferred embodiment.

When the electric motor 12 operates, rotation of the motor shaft 17 is transmitted to the steering arm 26 with its rotational speed reduced as described above, and the outboard motor main body 7 turns to the right or the left. The reverse input shutoff clutch 20 transmits approximately 100% of the output from the electric motor 12 to the speed reducing gear train 13 at this point.

However, a reverse driving torque causing the motor shaft 17 of the electric motor 12 to rotate in the opposite direction occurs, for example, when the steering force due to propeller reaction and/or water current pushes the outboard motor main body 7 back to a straight traveling state is applied to the outboard motor main body 7 during counter-steering. At this time, the reverse input shutoff clutch 20 locks rotation of a shaft on the output side, and locks the outboard motor main body 7 to prevent it from turning. Thereby, a steering angle is retained.

Accordingly, it is not required to keep applying a driving force of the electric motor 12 to the outboard motor main body 7 to generate a steering retaining force to retain the steering angle. Electric power supply to the electric motor 12 can be stopped, and electric power consumption can be considerably reduced.

Specifically, a controlling device (CPU or the like) arranged to control the electric motor 12 executes a real-time detection of an amount of steering by the operator of the watercraft (for example, a turning amount of a steering device) with the steering angle detecting sensor 28 or a steering sensor (not shown). If there is no change in the steering amount during a prescribed period (for example, several seconds), the controlling device determines that it is in a steering retaining state, and stops the electric power supply to the electric motor 12.

The reverse input shutoff clutch 20 which is used as the steering retaining device is a mechanical element. Therefore, it has a simple construction, and is more reliable. The reverse input shutoff clutch 20 is highly reliable for these reasons. Further, the reverse input shutoff clutch 20 does not require electric power for its operation, and thus can maintain the steering retaining force in a circumstance where electric power is not sufficiently supplied, such as during a power failure. Therefore, the concern that a steering angle becomes off a target angle due to propeller reaction and/or water current can be eliminated. The reverse input shutoff clutch 20 is highly reliable in this respect also.

Further, the reverse input shutoff clutch 20 is compact in size. Thereby, the entire electric steering device 10 can be compactly constructed with a lower cost. In particular, the reverse input shutoff clutch 20 is provided coaxially with the motor shaft 17 of the electric motor 12. Therefore, the reverse driving torque applied from the outboard motor main body 7 can be damped to a minimum by the speed reducing gear train 13 and the ball screw device 14. This allows a reduction in the torque capacity of the reverse input shutoff clutch 20 and further results in size reduction. The electric steering device 10 can be made even more compact.

The motor shaft 17 of the electric motor 12 and the ball screw shaft 21 of the ball screw device 14 are disposed next to each other in the watercraft fore-and-aft direction in a manner such that each of their axial lines is along the watercraft width direction. Accordingly, an entire arrangement of the electric steering device 10 is made compact, and thus can be disposed in the steering compartment 11 thereby effectively using space. Further, this largely contributes to the size reduction of the entire outboard motor.

Second Preferred Embodiment

Figure 3:
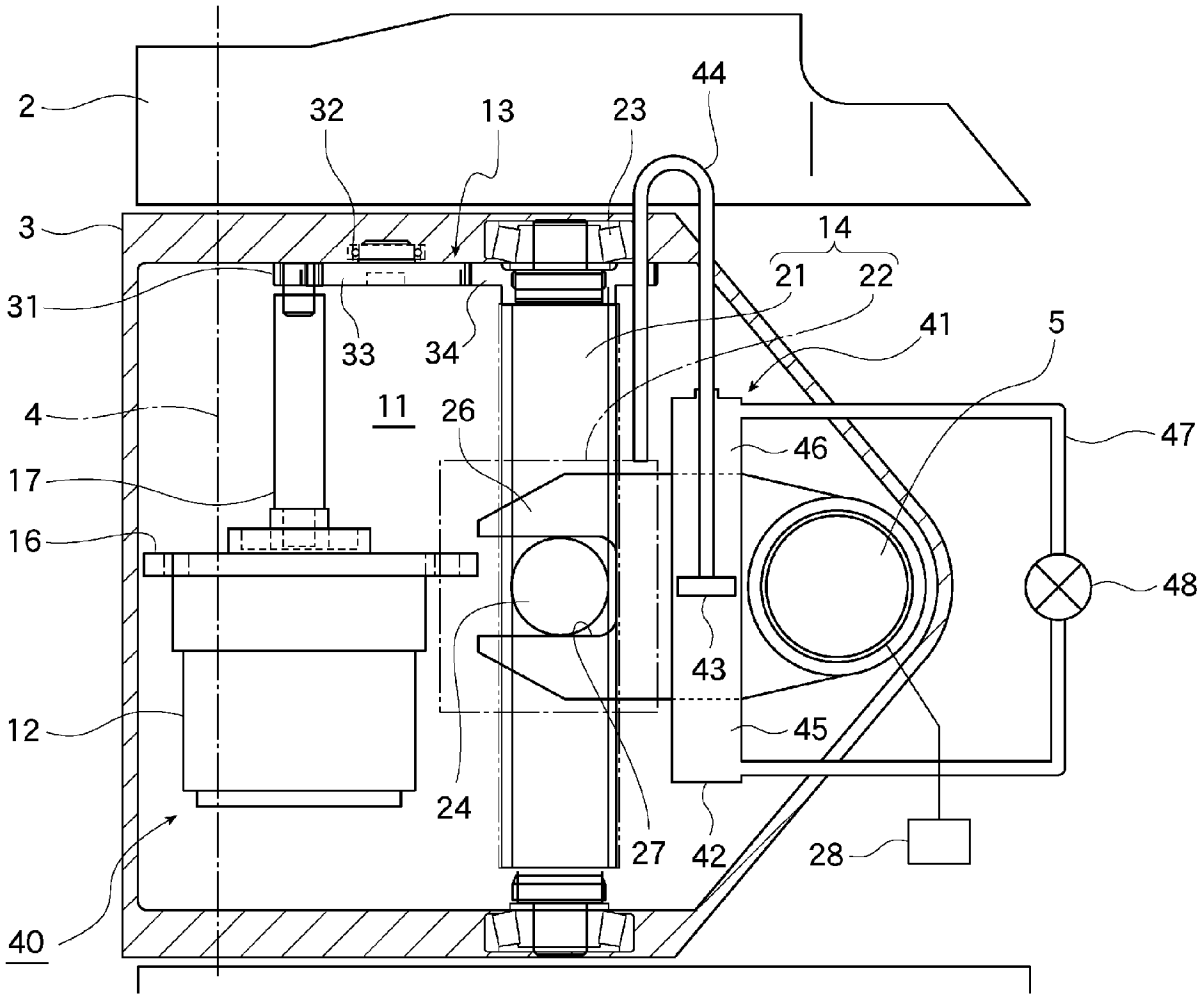
FIG. 3 is a plan view of a steering portion of an outboard motor of an electric steering device for a watercraft in accordance with a second preferred embodiment of the present invention.

FIG. 3 is a plan view of a vicinity of a steering portion of an outboard motor of an electric steering device for a watercraft in accordance with a second preferred embodiment of the present invention. In FIG. 3, the same reference numerals are given to the same features for the electric steering device shown in FIGS. 1 and 2, and descriptions thereof will be omitted.

A steering retaining device is not provided on the motor shaft 17 of the electric motor 12 in an electric steering device 40 in the present preferred embodiment. The steering retaining device is a stopper hydraulic cylinder 41 provided in a vicinity of the ball screw device 14.

In the stopper hydraulic cylinder 41, a piston 43 is slidably provided in a horizontally arranged cylinder 42. A piston rod 44 extending from the piston 43 extends outside from a right end of the horizontal cylinder 42, curves in a U-shape, and is coupled to the ball nut 22 of the ball screw device 14. The stopper hydraulic cylinder 41 has a loop path 47 connecting oil chambers 45 and 46 arranged on both sides of the piston in the horizontal cylinder 42. The oil chambers 45, 46 and the loop conduit 47 are filled with hydraulic oil. A shut-off valve 48 is provided substantially in the middle of the loop conduit 47.

When the ball nut 22 moves in the axial direction of the ball screw shaft 21 as the outboard motor main body 7 is steered, the piston 43 slides in the horizontal cylinder 42 via the piston rod 44, and thereby hydraulic oil in the oil chambers 45 and 46 flow into each other through the loop path 47. However, the hydraulic oil in the oil chambers 45 and 46 cannot flow into each other if the shut-off valve 48 is closed. Accordingly, movement of the piston 43 is locked, movement of the ball nut 22 is also locked, and thus a steering angle of the outboard motor main body 7 is retained. As described above, the stopper hydraulic cylinder 41 enters a free flowing state when the shut-off valve 48 is open, and changes to a steering retaining state when the shut-off valve 48 is closed.

Figure 4:
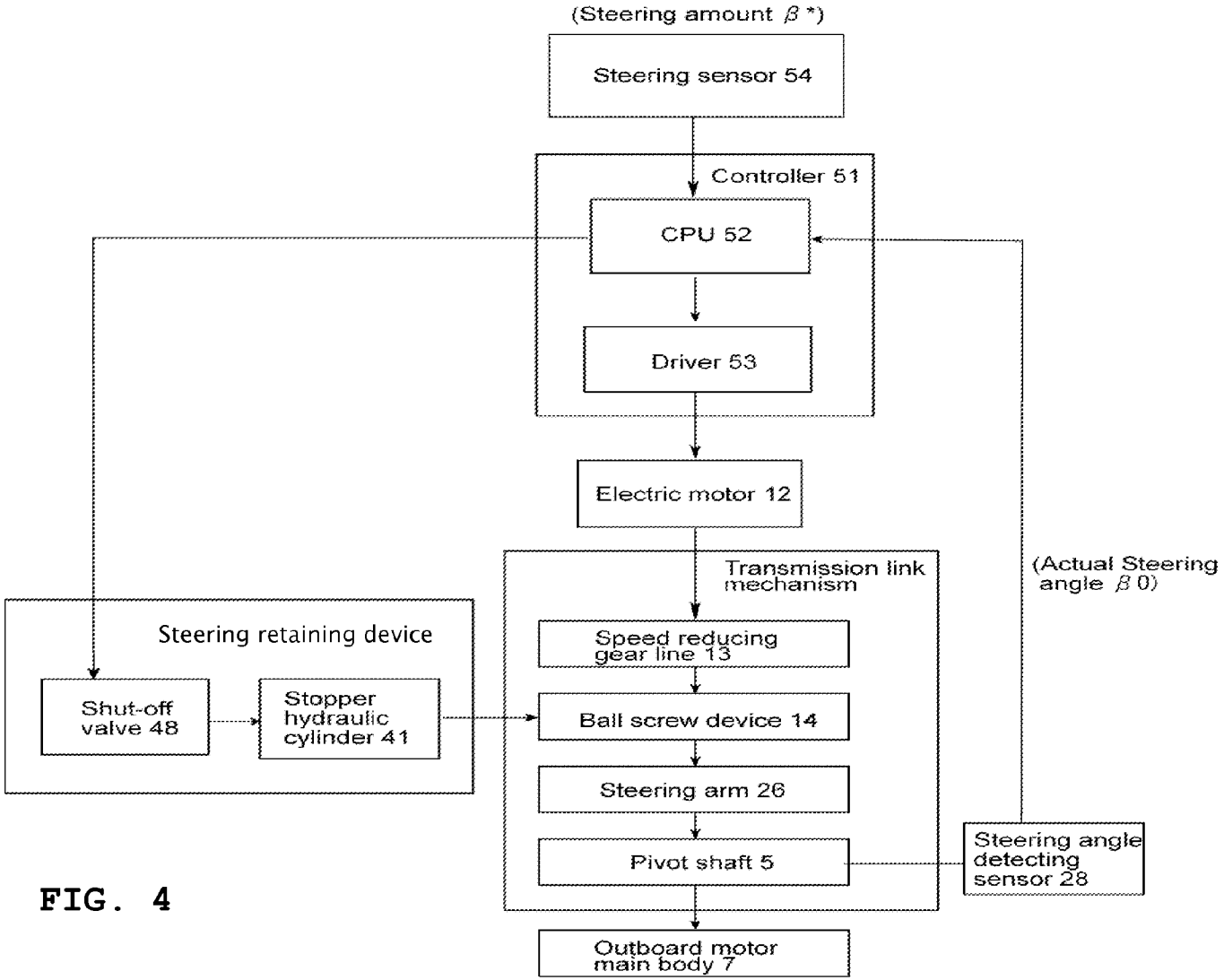
FIG. 4 is a block diagram showing a control system of a preferred embodiment of the electric steering device.

FIG. 4 is a block diagram showing a control system of the electric steering device 40. A controller 51 contains a CPU 52 and a driver 53. The driver 53 receives an instruction from the CPU 52, and controls a supply voltage to the electric motor 12.

A steering sensor 54 and the steering angle detecting sensor 28 are connected to the CPU 52. A steering amount $\beta^*$ made by an operator of the watercraft is input from the steering sensor 54. An actual steering angle $\beta_0$ of the outboard motor main body 7 is input from the steering angle detecting sensor 28. The shut-off valve 48 of the stopper hydraulic cylinder 41 is electrically connected to the CPU 52, and opening or closing of the valve is controlled by the CPU 52. That is, the CPU 52 controls shifting between the steering retaining state and the free state of the stopper hydraulic cylinder 41.

The CPU 52 detects the steering retaining state that a steering angle of the outboard motor main body 7 is retained from a steering condition of the outboard motor main body 7 and an operational state of the stopper hydraulic cylinder 41, and thereby stops electric power supply to the electric motor 12.

Specifically, the CPU 52 controls the electric motor 12 via the driver 53 such that the steering amount $\beta^*$ is equal to the actual steering angle $\beta_0$ while the watercraft is traveling. In a case of counter-steering, and so forth, the CPU 52 closes the shut-off valve 48 and causes the stopper hydraulic cylinder 41 to be in the steering retaining state. Thereby, the CPU 52 retains a steering angle of the outboard motor main body 7, and at the same time stops electric power supply to the electric motor 12. Accordingly, electric power consumption of the electric motor 12 can be largely reduced.

Figure 5:
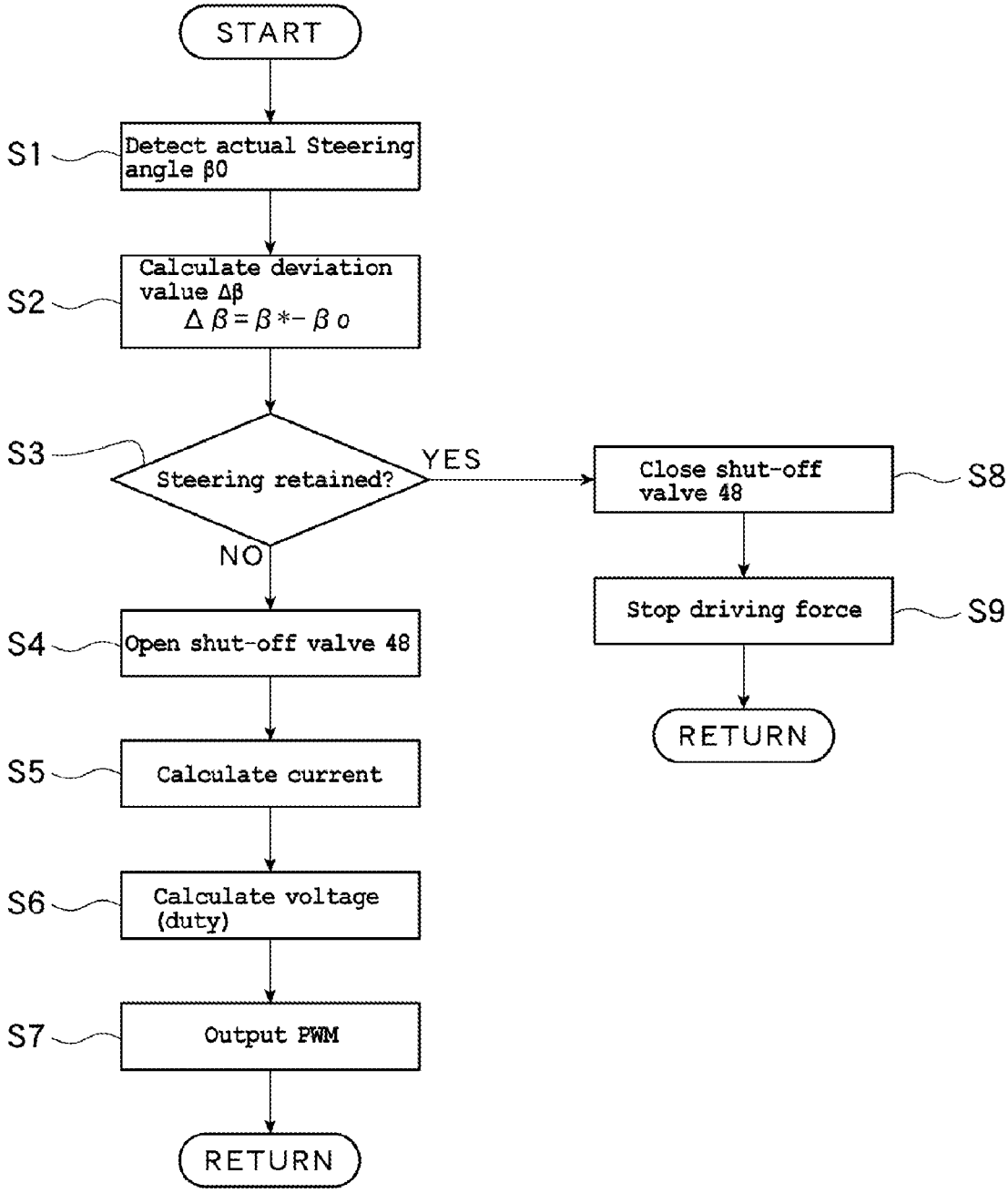
FIG. 5 is a flowchart of a control process that can be used to stop an electric power supply to an electric motor while retaining the correct steering angle.

FIG. 5 is a flowchart describing a control method. When the control method is started, the actual steering angle $\beta_0$ is detected in step S1, and a deviation value $\Delta\beta$ between the steering amount $\beta^*$ and the actual steering angle $\beta_0$ is calculated in step S2. Next, a determination is made whether the stopper hydraulic cylinder 41 is in the steering retaining state or not in step S3. If the determination is NO in step S3, opening of the shut-off valve 48, current calculation, voltage calculation, outputting PWM and so forth are executed in the following steps S4 through S7, and the electric motor 12 is operated.

On the other hand, if the determination is YES in step S3, the CPU 52 outputs an instruction to close the shut-off valve 48 in the next step S8. Further, electric power supply to the electric motor 12 is stopped in step S9, and generation of the driving force is stopped. The control method then returns to the start.

Figure 6:
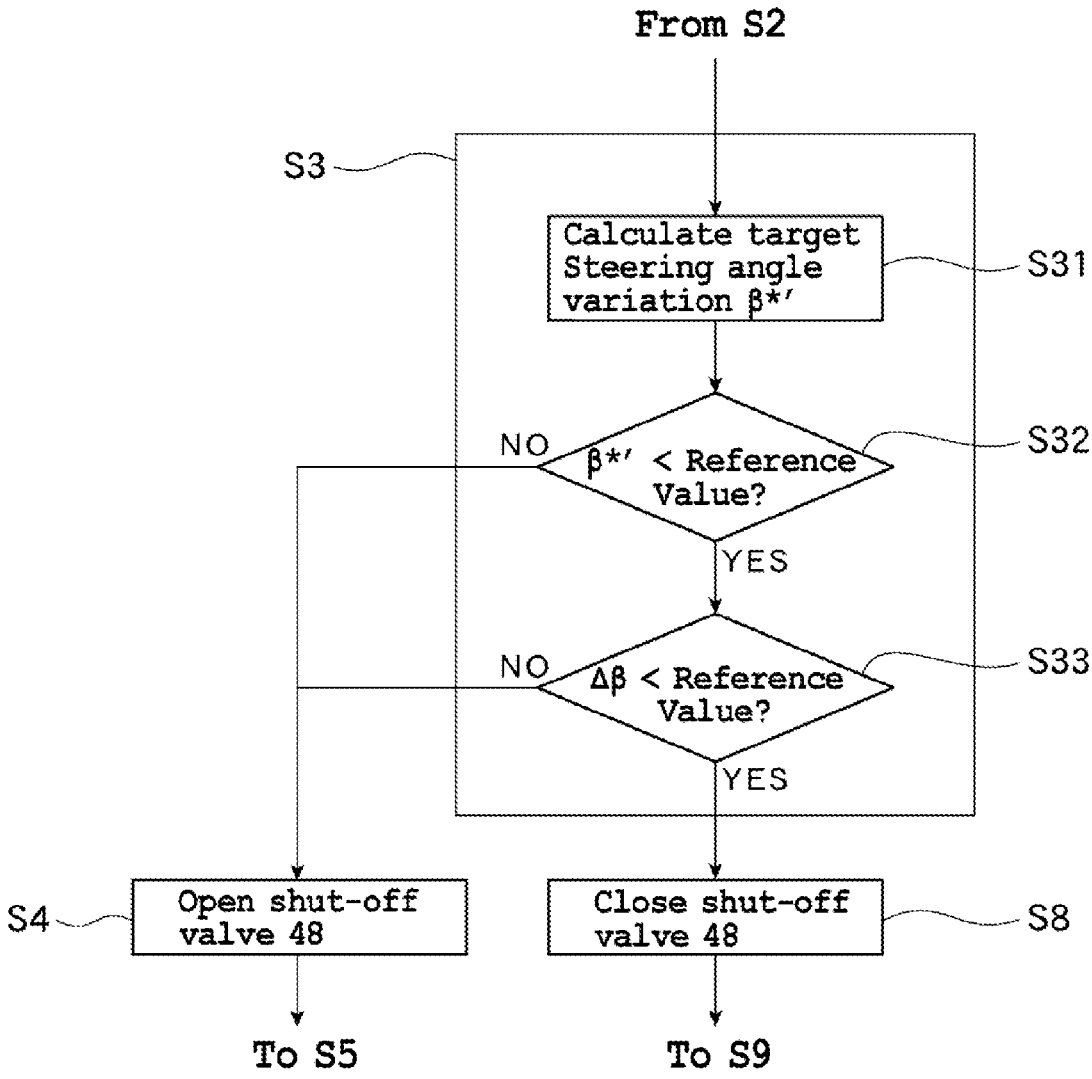
FIG. 6 is a flowchart showing the details of a determination process in step S3 shown in FIG. 5.

FIG. 6 is a flowchart showing the determination process in step S3 in detail. In step S3, a variation $\beta^{*\prime}$ in a target steering angle is calculated first in step S31. Next, a determination is made whether the variation $\beta^{*\prime}$ in a target steering angle is with in a reference value or not in step 32. If the determination is YES in step S32, a determination is made whether the deviation value $\Delta\beta$ is within a reference value or not in step S33. If the determination is YES in step S33, the process progresses to step S8, and the CPU 52 outputs an instruction to close the shut-off valve 48. If the determination is NO in step S32 or step S33, the process progresses to step S4.

The CPU 52 can control the shifting between the steering retaining state and the free state of the stopper hydraulic cylinder 41 which, in the present preferred embodiment, is the steering retaining device in the electric steering device 40. Therefore, retention of a steering angle or release from the retention can be more precisely and more effectively controlled.

Figure 7A:
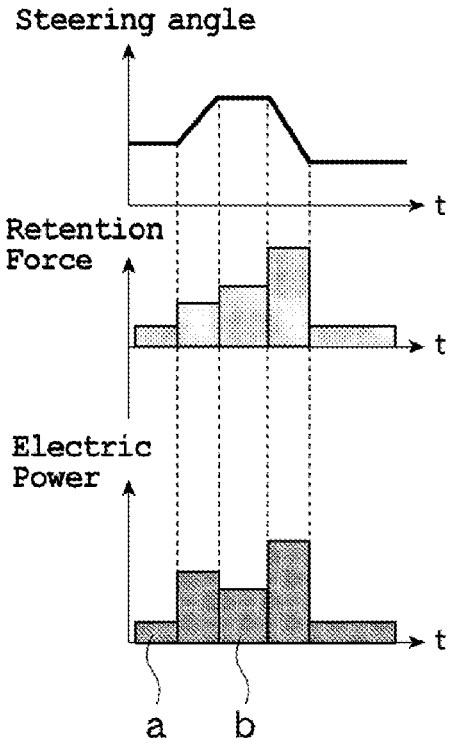
FIG. 7A Prior Art
FIGS. 7A and 7B show the relationship between a steering amount and a required electric power in the conventional art and a preferred embodiment of the present invention, respectively.
Figure 7B:
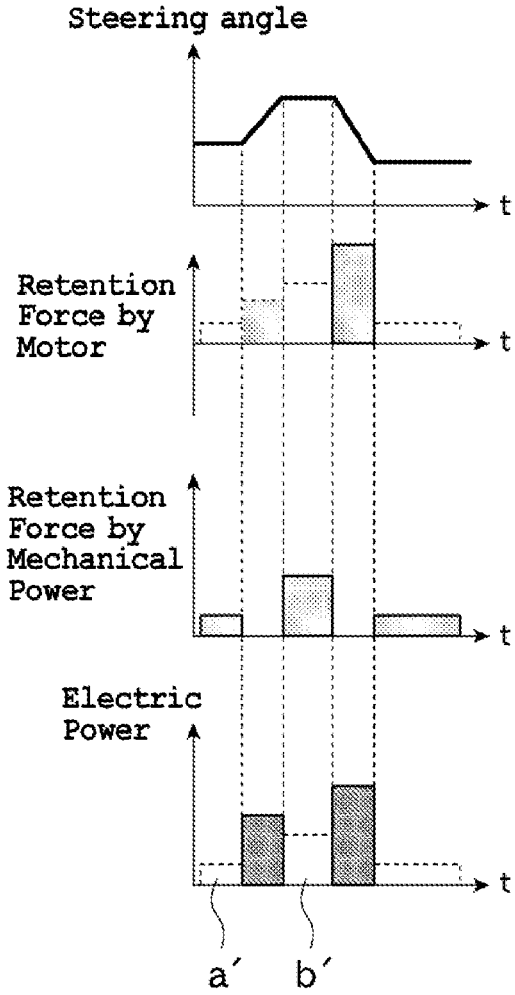

FIG. 7A is a graph indicating the relationship between a steering amount and the required electric power in a conventional electric power steering device for a watercraft without a steering retaining device. FIG. 7B is a graph indicating the relationship between the steering amount and the required electric power in a power steering device in accordance with preferred embodiments of the present invention.

Conventionally, both steering and steering retention are operated by a driving force of an electric motor, and thus a large amount of electric power is required for the steering retention as shown by parts (a) and (b) in FIG. 7A. However, electric power for the steering retention can be saved, as shown by parts (a') and (b') in FIG. 7B, with the power steering device in accordance with preferred embodiments of the present invention. Accordingly, electric power consumption can be largely reduced.

The CPU 52 closes the shut-off valve 48 when the electric power supply to the electric motor 12 is stopped, and controls the stopper hydraulic cylinder 41 to become the steering retaining state such that a steering angle of the outboard motor main body 7 is retained.

Accordingly, a steering retaining force can be maintained in a circumstance when electric power is not sufficiently supplied, such as during a power failure. Further, a steering angle can be fixed, and thereby stability of the hull can be retained in cases when the watercraft is not in use, for example, when the watercraft is towed by another watercraft, and so forth.

Other Preferred Embodiments

In the above first and second preferred embodiments, description is made with respect to an electric steering device of an outboard motor. However, the preferred embodiments of the present invention are not limited to outboard motors, but can be widely applied to electric steering devices of watercrafts including rudders or other similar steering devices (for example, rudder bodies).

In the above first and second preferred embodiments, description is about a case in which the speed reducing gear train 13 and the ball screw device 14 are used as the speed reducing device. However, the preferred embodiments of the present invention are not limited to this construction.

The preferred embodiments of the present invention can be widely applied to general watercraft, pleasure boats, small planing boats, personal watercraft, etc.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An electric steering device for a watercraft comprising:

an electric driving device arranged to provide power to perform a steering operation of the watercraft;

a steering retaining device arranged to retain a preferred steering angle against an external steering force applied to a rudder body from outside of the watercraft; and a controlling device arranged and programmed to cut off electric power to the electric driving device; wherein the steering retaining device blocks a reverse input from the rudder body to the electric driving device when the controlling device cuts off the electric power to the electric driving device when the rudder body is retained at the preferred steering angle.

2. The electric steering device for a watercraft according to claim 1, wherein the steering retaining device includes a reverse input shutoff clutch.

3. The electric steering device for a watercraft according to claim 1, further comprising a speed reducing device arranged between the electric driving device and the rudder body, wherein the electric driving device is an electric motor arranged to transmit power to the rudder body after a speed of the output of the electric motor is reduced by the speed reducing device, and the steering retaining device is arranged within a rotation transmitting path between the electric motor and the speed reducing device.

4. The electric steering device for a watercraft according to claim 3, wherein the steering retaining device is provided substantially coaxially with a motor shaft of the electric motor.

5. The electric steering device for a watercraft according to claim 3, wherein the speed reducing device includes a speed reducing gear train and a screw device;

the speed reducing device is arranged such that rotation of the electric motor is transmitted to a screw shaft of the screw device after the speed of the output of the electric motor is reduced by the speed reducing gear train; and the motor shaft of the electric motor and the screw shaft are disposed adjacent to each other in a watercraft fore-and-aft direction such that an axial line of each of the motor shaft and the electric motor is substantially along a watercraft width direction.

6. The electric steering device for a watercraft according to claim 1, wherein the controlling device is arranged to control shifting of the steering retaining device between a steering retaining state and a free state.

7. The electric steering device for a watercraft according to claim 1, wherein the steering retaining device is a hydraulic cylinder including a piston and a piston rod.

8. The electric steering device for a watercraft according to claim 7, wherein the speed reducing device includes a screw device having a screw shaft and a nut, the piston rod of the hydraulic cylinder is coupled to the nut of the screw device, and the hydraulic cylinder includes a loop path connecting chambers on both sides of the piston.

9. The electric steering device for a watercraft according to claim 8, wherein the loop path includes a shut-off valve arranged to prevent the flow of hydraulic fluid between the chambers.

10. A method for controlling an electric steering device for a watercraft comprising the steps of:

detecting whether a steering angle of a rudder body is retained in a steering retaining state based on a steering state of the rudder body; and stopping electric power supply to an electric driving device arranged to steer the rudder body when it has been detected that the steering angle of the rudder body is retained in the steering retaining state; wherein the step of detecting whether the steering angle of the rudder body is retained in the steering retaining state includes:

detecting whether there is a change in the steering angle of the rudder body for a prescribed period of time.

11. The method for controlling an electric steering device for a watercraft according to claim 10, further comprising the step of:

blocking a reverse input from the rudder body to the electric driving device to maintain the steering retaining state of the rudder body.

12. The method for controlling an electric steering device for a watercraft according to claim 11, wherein the step of blocking of a reverse input includes:

preventing a reverse driving torque from being applied from the rudder body to the electric driving device.

* * * * *